United States Patent [19]

Dickins, III et al.

[11] Patent Number: 4,899,944

[45] Date of Patent: Feb. 13, 1990

[54] YARN WINDING APPARATUS AND PROCESS

[75] Inventors: John S. Dickins, III, Wilmington, N.C.; Thomas D. Williamson, Lugoff, S.C.

[73] Assignee: E. I. Du Pont de Nemours and Company, Wilmington, Del.

[21] Appl. No.: 284,586

[22] Filed: Dec. 15, 1988

[51] Int. Cl.[4] ..... B65H 54/20; B65H 54/30; B65H 57/04

[52] U.S. Cl. ..... 242/35.5 R; 242/18 PW; 242/43 R; 242/157 R; 242/158.3

[58] Field of Search ..... 242/35.5 D, 18 R, 18 DD, 242/18 PW, 43 R, 42, 157 R, 158.3

[56] References Cited

U.S. PATENT DOCUMENTS

| | | | |
|---|---|---|---|
| 3,373,949 | 3/1968 | Swallow | 242/43 R |
| 3,653,860 | 4/1972 | Smith et al. | 242/42 X |
| 3,672,587 | 6/1972 | Pierce | 242/43 R |
| 4,187,994 | 2/1980 | Lyons | 242/35.5 R |

FOREIGN PATENT DOCUMENTS

| | | |
|---|---|---|
| 2146200 | 6/1973 | France . |

*Primary Examiner*—Stanley N. Gilreath

[57] ABSTRACT

A string-up system and apparatus, using a novel dual-slotted traverse guide, with preferential string up of a first yarn in the one slot, associated with transfer means to move a yarn, if desired, out of the first slot, so this yarn is strung up in the second slot.

14 Claims, 2 Drawing Sheets

YARN WINDING APPARATUS AND PROCESS

FIELD OF THE INVENTION

This invention relates to the packaging of yarns, and more particularly to dual-slotted reciprocating traverse guides for use with winders therefor.

BACKGROUND

Filament yarns are conventionally packaged by being wound helically to form a bobbin of yarn on an axially-rotating cylindrical package support. Generally, for economical use of space, more than one package of yarn is wound simultaneously, using common or related drive and/or winding means. For simplicity, the present invention will be described specifically in relation only to previous winders that are designed for winding two yarn packages on supports that are located with their cylindrical axes located in parallel, usually at different heights. The helical winding configuration is obtained by a traverse guide that functions to sweep or to traverse the yarns from end to end of the parallel pair of yarn packages, and the traverse mechanism may guide the yarns directly to the packages or may guide the yarns first to a drive roll, or print roll, and thence to the packages.

Most present commercial winders (yarn winding apparatus) use a separate single-slotted traverse guide to wind each bobbin (i.e. package of yarn). The traverse guides have only one yarn (sometimes termed a threadline) in each guide-slot. A single traverse mechanism may supply more than one package from more than one traverse guide, each guide being appropriately located opposite its package. Thus (in most present commercially-available winders) there is only one yarn in each guide-slot, and so such winders are termed single end winders.

There have been some prior art winders that have been designed to wind two ends of yarn, with both ends of yarn advancing through the same single slot in the traverse guide to the rotating package. However, when two threadlines occupy a common guide slot, it is found that threadline interactions cause package defects known as overthrown ends, in which a short length of yarn in a reversal "falls" off the end of the package and lies along a chord across the end of the package. Such defects are more frequent with double end winding, than with single end winding. A further defect, that occurs when unwinding yarn packages, especially at very high speeds, such as 1,000 mpm, is known as shelling, when more than one loop of yarn comes off the package at the same time, and the extra loops tend to snag, e.g. on guides, get tangled, or cause sudden tension drops that can result in difficulties downstream. Increasing the helix angle can reduce such defects, but leads to other problems, that are well known. A further drawback is a package defect known as a doubleend pickup in which the yarn lines intertangle, breaking one yarn line, which then causes both yarn lines to wind to a single package instead of separating with one yarn line per package.

Accordingly, because of such defects, dual-slotted devices have previously been proposed wherein the slots are located close together, as suggested, for example, in IWKA French Certificate of Utility 2,146,200 and Lyons, U.S. Pat. No. 4,187,994. The IWKA French Certificate shows guide-slots on two different levels, i.e. an outer guide-slot (referenced *6a*) and a lower guide-slot (referenced *6b*), located to one side of the upper guide-slot, and the threadlines are kept separate before approaching the slots by stationary means, preferably a vertical plate (referenced 7), located upstream. Lyons shows an outer guide-slot at the outer end of a traverse guide-plate, which is of generally isosceles triangular shape, while another guide-slot is located in the sloping side of the guide-plate, i.e. to one side of and somewhat below the outer guide-slot, and an elongated guide member is provided whereby only the outer slot is exposed, so that a first yarn can only be strung up in this outer slot, and then the other lower slot (in the sloping side of the guide plate) is also exposed, so the second yarn may be strung up in this second slot.

Previous suggestions for dual-slotted traverse guides have not proved entirely satisfactory, e.g. in complications, flexibility, maintenance problems and curing the defects referred to (for a common guide-slot); so it is an object of the present invention to provide a better system for winding with a dual-slotted traverse guide. For convenience, however, reference may be made to Lyons, the disclosure of which is hereby incorporated by reference.

SUMMARY OF THE INVENTION

In order to avoid these drawbacks, a traversing guide system has been devised for a yarn windup, including a source of at least two yarns, a fixed guide through which said yarns advance in a plane from said source to a traverse guide from which the yarns advance as they are being wound in a reciprocating stroke on respective package supports, said traverse guide being adapted to reciprocate within first and second limits defining a traversing zone and comprising: a base, a guide plate embedded in and projecting outwardly from the base, said plate having a peripheral edge that comprises a first convexly curved section, a generally straight section that is generally parallel to said plane, and a second convexly curved section, the curved sections being separated from the straight section by open-ended guide-slots that open into each curved section; means for feeding a yarn from beyond said first limit into the slot adjacent said first limit; and means for transferring a yarn from said slot adjacent said first limit to the other slot.

There is also provided, according to the present invention, an improved process for sequentially stringing up two yarns in a dual-slotted traverse guide, wherein the improvement is characterized by first stringing up one yarn in a first slot on a first side of said guide, followed by lifting said first yarn out of said first slot and transferring said first yarn to a second slot, and then stringing up a second yarn in said first slot. This improved process preferably involves, in essence, ensuring that one of the two slots is strung up preferentially, and filling the other slot by transferring a yarn from such preferred slot, and then stringing up the preferred slot again. By doing this, and actuating transfer means positively, when it is desired to string up the second slot, an elegant way has been found to ensue sequential string up of both slots, and that lends itself to automation without undue expense, but with reliability, in practical operation. We have found that this system is more reliable in avoiding the defects referred to.

Preferred transfer means are ramp means, such as pivoted means, e.g. a plate or wire, or spring means, especially a spring wire, adapted to lift a yarn out of a slot, means for moving said ramp means from a first position to a second position, and a timing device adapted to ensure said ramp means is held in said second position for at least a complete traverse cycle with e.g. pneumatic, hydraulic or electric means for moving the ramp means.

According to the present invention, there is also provided a novel traverse guide comprising: a base, a guide plate embedded in and projecting outwardly from the base, said plate having a peripheral edge that comprises a first convexly curved section, a generally straight section that is generally parallel to said base, and a second convexly curved section, the curved sections being separated from the straight section by open-ended guide-slots that open into the curved sections, and are preferably parallel to one another.

According to another aspect of the invention, there is provided a windup, including a source of at least two yarns, a fixed guide through which said yarns advance in a plane from said source to a traverse guide from which the yarns advance as they are being wound in a reciprocating stroke on respective package supports, said traverse guide being adapted to reciprocate within first and second limits defining a traversing zone and comprising: a base, a guide plate embedded in and projecting outwardly from the base, said plate having a peripheral edge that comprises a first convexly curved section, a generally straight section that is generally parallel to said plane, and a second convexly curved section, the curved sections being separated from the straight section by open-ended guide-slots that open into the curved sections; means for feeding a yarn from beyond said first limit into the slot adjacent said first limit; and means for feeding a yarn from beyond said second limit into the slot adjacent said second limit.

The guide-slots are preferably arranged to be in a generally parallel direction to each other.

DETAILED DESCRIPTION

Figure 1:
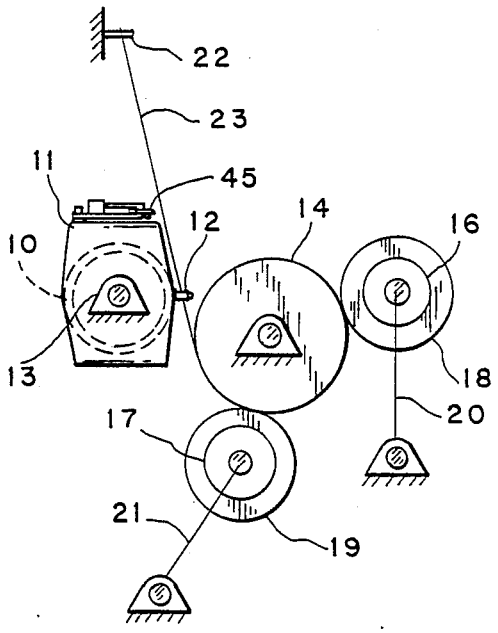
FIG. 1 is a diagrammatic end-elevational view of one type of winder to which the present guide is applicable.

The present guide is applicable to a number of winders. FIG. 1 illustrates the one shown for purposes of illustration which generally comprises a barrel cam 10, a cam housing 11, a traverse guide 12, fixed bearings 13 which carry the cam 10, a fixed drive roll 14 in bearings 15, a pair of chucks 16, 17 each carrying bobbins 18, 19 and each mounted on a pivotally mounted swing arm 20, 21. Situated on top of the cam housing 11, is a spring wire, indicated generally as 45. Above the winder is a fixed guide 22 (often called a fanning guide) for the yarn 23.

Figure 2:
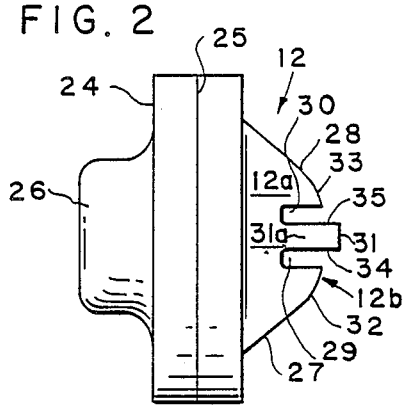
FIG. 2 is an enlarged plan view of the entire traverse guide of the present invention.
Figure 3:
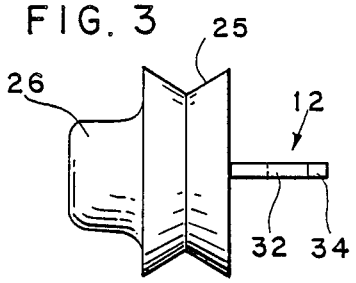
FIG. 3 is an end-elevational view of the guide of FIG. 2.

Referring to FIGS. 2 and 3, the traverse guide 12 of the present invention comprises a guide plate **12*a* embedded in and projecting outwardly from a base 24 comprising a molding (e.g., of Zytel® nylon resin or other suitable material) having a grooved rail-engaging portion 25 and a cylindrical cam-engaging portion 26 for engaging the generally helical groove of the barrel cam 10. Guide plate 12*a*, of a wear-resistant material (e.g., ceramic), is of generally isosceles triangular shape, as indicated by edges 27, 28 that form a peripheral edge 12*b*, that is parallel open-ended guide-slots 29, 30, and that comprises first and second convexly curved sections 32, 33, into which open these slots 29, 30, on either side of a central generally straight section 31 on a segment 31*a* of the plate that extends beyond the locations where these convexly curved sections 32, 33 would project, if continued across the entrances to slots 29, 30, thus leaving exposed portions 34, 35 of the inside walls of slots 29, 30, i.e. of the sides of central segment 31*a* that extends out further than the rest of peripheral edge 12*b*; this feature is believed important in preventing inadvertent/undesired transfer of a yarn between slots 29, 30**.

Figure 4:
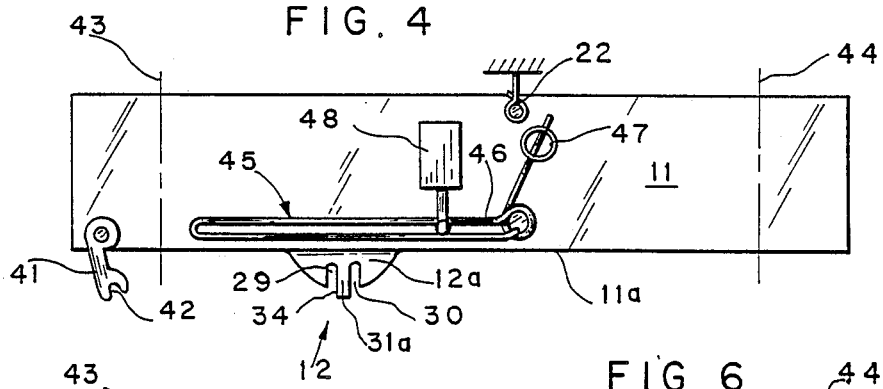
FIG. 4 is a plan view of principal parts of the yarn guide of the present invention shown installed in a preferred barrel cam-driven traverse mechanism.
Figure 5A:
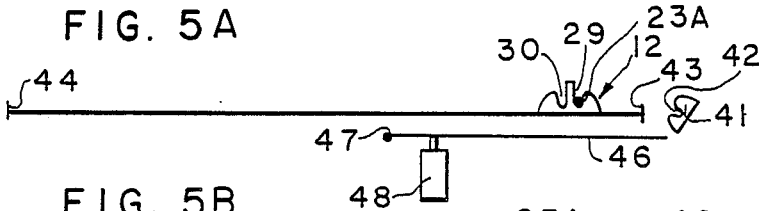
FIGS. 5A–5F are diagrammatic views of a preferred string up sequence according to the process of the invention.

Referring now to FIGS. 4 and 5A–5F, situated on top of the cam housing 11 is a pivoted yarn guide 41 of the type taught by Lyons, U.S. Pat. No. 4,187,994, which has a yarn guide notch 42 which is located slightly beyond a first limit 43 of the traversing zone (i.e., outside the limits 43, 44 of the package to be wound). Traverse guide 12 can be seen protruding beyond edge **11*a* of cam housing 11, between limits 43, 44. Prior to winding, the pivoted guide 41, in a cocked position, holds a running yarn line in notch 42 (outside the limits of a normal traverse stroke) while the yarn runs temporarily to a sucker gun (i.e., to waste); the guide also positions the yarn so that it cannot yet start winding on an empty bobbin support. On being released, e.g. by a manual release, from the cocked position, the guide 41 pivots and releases the yarn, which quickly becomes snagged in slot 29, located adjacent limit 43 and guide 41 (after being snagged in a groove on the bobbin, as disclosed by Lyons, and hereinafter). In operation, the guide 41 may be manually placed in the cocked position. Two running ends of yarn (e.g., from a spinning machine) are picked up by means of a portable air-aspirated sucker gun and are manipulated into guide 22, after which one of the two ends of yarn (the one which will be strung up second) is placed temporarily in another fixed guide (not shown) positioned so as to prevent that second end of yarn from engaging any part of the winder, while the first end is strung up. The first end of yarn 23A is manipulated into notch 42 in guide 41, around drive roll 14, around empty bobbin 19 and thence to a position generally clear of the winder and somewhat outside the traverse stroke. Next, guide 41 is released from its cocked position to effect the release of the yarn from notch 42, so the yarn 23A becomes snagged in the groove in the bobbin 19, forms a transfer tail, and subsequently, is caught up in slot 29 of moving traverse guide 12, as shown in FIG. 5A. This latter occurs because slot 29 is adjacent guide 41, and limit 43 of the traversing zone. The yarn is preferentially strung up in slot 29, rather than slot 30 which is remote from limit 43. The yarn is under tension, so is not likely to ride up over central segment 31*a*, which extends out between slots 29 and 30, and beyond the entrance to slot 29 in first convexly curved section 32. In other words, the exposed wall portion 34 of central segment 31***a* prevents the yarn from being strung at this time into slot 30.

Figure 5B:
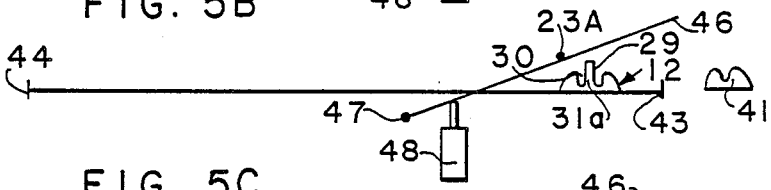

The spring wire 45 comprises an arm 46 that is movable about an anchor 47 that is fixed to the top of the cam housing 11, with the arm 46 normally located parallel with the edge 11*a* of the cam housing 11, as shown in FIGS. 4 and 5A, i.e. so as not to extend out beyond the edge 11*a* of the cam housing 11, but is adapted to be movable by pneumatic means, indicated generally as 48, so that the end of the arm 46 remote from anchor 47 will swing out beyond the edge 11*a* of the cam housing 11, as shown in FIG. 5B.

Figure 5C:
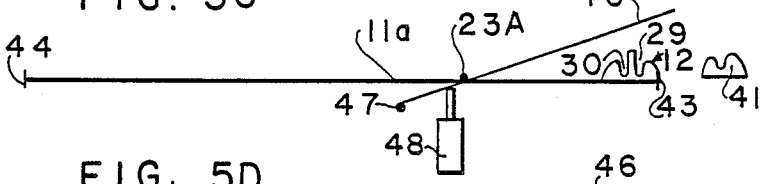
Figure 5D:
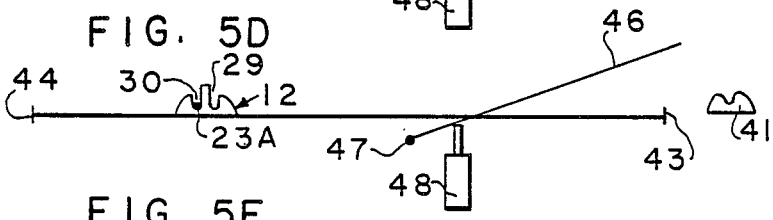
Figure 5E:
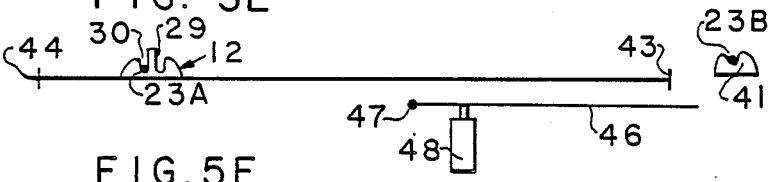
Figure 5F:
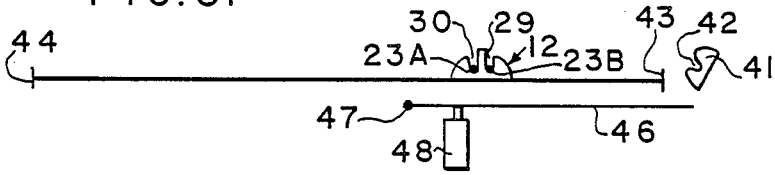

As described above, and as shown in FIG. 5A, when any yarn is released beyond limit 43 from notch 42 in guide 41, it will be caught in adjacent slot 29 of moving traverse guide 12. When it is desired to string up slot 30, pneumatic means 48 are activated to elevate and swing arm 46 out so that it lifts yarn 23A out of slot 29 beyond central segment 31*a* of guide 12, as shown in FIG. 5B. While arm 46 remains in the elevated position, tension on the yarn 23A (from fixed guide 22) causes yarn 23A to move down the ramp formed by inclined arm 46 onto edge 11A of the cam housing 11, as shown in FIG. 5C. Meanwhile, traverse guide 12 has continued to move within limits 43 and 44, as shown in FIGS. 5B and 5C, and will eventually complete the stroke, i.e. reach limit 43, as shown in FIG. 5C, and then start to move back towards limit 44. As traverse guide 12 moves towards limit 44, it will pick up yarn 23A in slot 30, as shown in FIG. 5D. After maintaining swing arm 45 in the elevated ramp position, as shown in FIGS. 5B, 5C and 5D, for more than one complete cycle, so as to ensure that yarn 23A is transferred from slot 29 to slot 30, pneumatic means 48 is deactivated, preferably by using appropriate timing means, not shown, such as a conventional pulse valve, e.g. a Clippard MINIMATIC PV-1 miniature pulse valve, available from Clippard Instrument Laboratory, Inc., Cincinnatti, Ohio 45239, so swing arm 45 returns to its original position, as shown in FIG. 5E. Then, after second yarn 23B has been manipulated into notch 42 in guide 41, and strung up around drive roll 14 and empty bobbin 18 and thence to a position generally below the winder and somewhat outside the traverse stroke, and guide 41 has been released from its cocked position to effect release of yarn 23B from notch 42, yarn 23B becomes snagged in a groove in bobbin 18, forms a transfer tail, and subsequently is caught up in slot 29, as shown in FIG. 5F. In other words, following this sequence, yarns 23A and 23B are strung up, respectively, in guide slots 30 and 29, because each yarn tends to be strung up preferentially in slot 29, rather than slot 30, but means are used to positively transfer only the first yarn 23A from slot 29 to slot 30, before stringing up the second yarn 23B in slot 29.

We have found, in practice, that use of this new winder and string-up sequence has provided advantages. As compared with Lyons, where string-up in the outer slot was not always reliable, string-up is more reliable, and the system has proved advantageous, in practice, and lends itself easily to automation, as will be readily understood.

Figure 6:
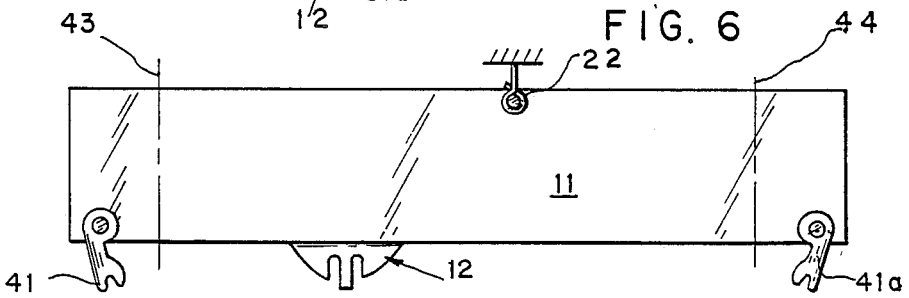
FIG. 6 is a plan view of principal parts of the yarn guide of the present invention shown installed in another arrangement, different from FIG. 4.

Although the winder and string-up sequence described above is preferred, and has many advantages, the novel traverse guide of the invention may also be adapted for use with other winding systems, not necessarily using the preferred string-up sequence. For instance, instead of using only one pivoted guide 41, stringing up consistently in one guide-sot, with transfer means to transfer such yarn from this first slot into the other slot, feed means, such as the pivoted guide 41, may be provided beyond each end of the traversing zone, as shown by 41, 41*a* in FIG. 6, in which the reference numerals are otherwise as in FIG. 4, whereby each pivoted guide can feed preferentially to the respective adjacent guideslot, and so no transfer means need be used, as will readily be understood. In some respects, providing two feed means, such as pivoted guides, and avoiding the need for transfer means, may prove satisfactory, depending on the particular applications and circumstances.

We claim:

1. A windup, including a source of at least two yarns, a fixed guide through which said yarns advance in a plane from said source to a transverse guide from which the yarns advance as they are being wound in a reciprocating stroke on respective package supports, said traverse guide being adapted to reciprocate within first and said second limits defining a traversing zone and comprising: a base, a guide plate embedded in and projecting outwardly from the base, said plate having a peripheral edge that comprises a first convexly curved section, a generally straight section that is generally parallel to said plane, and a second convexly curved section, the curved sections being separated from the straight section by open-ended guide-slots that open into the curved sections; means for feeding a yarn from beyond said first limit into the slot adjacent said first limit; and means for transferring a yarn from said slot adjacent said first limit to the other slot.

2. The windup of claim 1, wherein the guide-slots are generally parallel to each other.

3. The windup of claim 1 or 2, wherein said transfer means comprises ramp means, means for moving said ramp means from a first inactive position to a second position to lift a yarn out of a slot, and a timing device adapted to ensure said ramp means is held in said second position for at least a complete traverse cycle.

4. The windup of claim 3, wherein said ramp means is a pivoted plate.

5. The windup of claim 3, wherein said ramp means is a pivoted wire.

6. The windup of claim 3, wherein said ramp means is a spring wire.

7. The windup of claim 3, wherein pneumatic means ar provided to move said ramp means from the first position to the second position.

8. The windup of claim 3, wherein hydraulic means are provided to move said ramp means from said first position to said second position.

9. The windup of claim 3, wherein electric means are provided to move said ramp means from said first position to said second position.

10. An improved process for sequentially stringing up two yarns in a dual-slotted traverse guide, wherein the improvement is characterized by first stringing up one yarn in a first slot on a first side of said guide, followed by lifting said yarn out of said first slot and transferring said yarn to a second slot, and then stringing up a second yarn in said first slot.

11. A traverse guide comprising: a base, a guide plate embedded in an projecting outwardly from the base, said plate having a peripheral edge that comprises a first convexly curved section, a segment with a generally straight section that is generally parallel to said base, and a second convexly curved section, the curved sections being separated from the said segment with the generally straight section by open-ended guide slots that open into the curved sections, said segment projecting outwardly from said base beyond said curved sections.

12. A traverse guide according to claim 11, wherein the guide-slots are generally parallel to each other.

13. A windup, including a source of at least two yarns, a fixed guide through which said yarns advance in a plane from said source to a traverse guide from which the yarns advance as they are being wound in a reciprocating stroke on respective package supports, said traverse guide being adapted to reciprocate within first and second limits defining a traversing zone and comprising: a base, a guide plate embedded in and projecting outwardly from the base, said plate having a peripheral edge that comprises a first convexly curved section, a generally straight section that is generally parallel to said plane, and a second convexly curved section, the curved sections being separated from the straight section by open-ended guide-slots that open into the curved sections; means for feeding a yarn from beyond said first limit into the slot adjacent said first limit; and means for feeding a yarn from beyond said second limit into the slot adjacent said second limit.

14. The windup of claim 13, wherein the guide-slots are generally parallel to each other.

* * * * *